United States Patent [19]

Leguen et al.

[11] Patent Number: 4,734,927

[45] Date of Patent: Mar. 29, 1988

[54] EQUIPPED FORCE-CONVECTION HOUSING UNIT FOR A ROTATING-ANODE X-RAY TUBE

[75] Inventors: Jacques Leguen, Paris; André Plessis, Les Moulineaux, both of France

[73] Assignee: Thomson-CGR, Paris, France

[21] Appl. No.: 810,374

[22] Filed: Dec. 18, 1985

[30] Foreign Application Priority Data

Dec. 21, 1984 [FR] France ..... 84 19649

[51] Int. Cl.[4] ..... H01J 35/10

[52] U.S. Cl. ..... 378/200; 378/130; 378/141

[58] Field of Search ..... 378/127, 130, 131, 141, 378/200

[56] References Cited

U.S. PATENT DOCUMENTS

| | | | |
|---|---|---|---|
| 3,870,916 | 3/1975 | Küssel et al. | 378/130 |
| 4,369,517 | 1/1983 | Ozawa | 378/200 |
| 4,468,801 | 8/1984 | Sudo et al. | 378/130 |

FOREIGN PATENT DOCUMENTS

| | | |
|---|---|---|
| 2711847 | 7/1978 | Fed. Rep. of Germany . |
| 2170126 | 9/1973 | France . |
| 2484698 | 12/1987 | France . |
| 8302850 | 8/1983 | World Int. Prop. O. . |
| 2131224 | 6/1984 | United Kingdom . |

OTHER PUBLICATIONS

Patents abstracts of Japan, vol. 5, No. 27(E-46) (699), 18 Feb. 1981; & JP-A-55 154049 (Kiyouto Daigaku) 01-1-2-1980.

*Primary Examiner*—Janice A. Howell
*Assistant Examiner*—David P. Porta
*Attorney, Agent, or Firm*—Oblon, Fisher, Spivak, McClelland & Maier

[57] ABSTRACT

An equipped forced-convection housing unit for a rotating-anode X-ray tube comprises a flow-initiating device which is integrated in the housing unit and has the function of circulating the coolant fluid surrounding the X-ray tube. This arrangement simplifies the problems relating to supply of electric power to the motor which drives the flow-initiating device and the motor which drives the anode of the X-ray tube in rotation.

24 Claims, 3 Drawing Figures

1
2
3
4
5
7
8
10
11
12
13
14
15
16
17
18
19
20
21
22
23
24
25
26
27
28
29
30
31
32
33
34
35
36
37
38
39
40
41
42
43
44
M1
M2

EQUIPPED FORCE-CONVECTION HOUSING UNIT FOR A ROTATING-ANODE X-RAY TUBE

BACKGROUND OF THE INVENTION

1. Field of the Invention

The present invention relates to an equipped forced-convection housing unit for a rotating-anode X-ray tube as applicable to the general field of radiology and in particular to X-ray devices involving intensive production of X-radiation.

2. Description of the Prior Art

In X-ray tubes, the production of X-radiation is obtained by deceleration of electrons in the target material provided at the anode. This results in considerable heating of the target and of the entire anode, since approximately 99% of the injected energy is converted to heat.

By reason of the vacuum established within the X-ray tube, the greater part of the heat stored within the anode is removed by radiation through the envelope of the X-ray tube. The zones nearest the anode are particularly exposed to high temperatures. In order to avoid excessive local increases in temperature, it is therefore necessary to carry out a heat transfer operation in many cases of intensive use, as in vascular scannography, tomography, and so on. Failing this heat transfer, such local temperature rises would be liable to cause damage to the X-ray tube itself as well as certain components which are contained within a protective housing together with the X-ray tube.

The assembly formed by said housing which contains the X-ray tube is known as an equipped housing. As a general rule, the X-ray tube is immersed in a fluid with which the housing is filled. The fluid is usually oil.

The natural convection of the fluid as a result of the temperature gradient is often insufficient to transfer heat and to prevent the formation of very-high-temperature hot spots. In order to remedy this insufficiency, a known practice consists in producing forces convection or, in other words, causing the fluid to circulate under the action of an outside agency. This external action is usually produced by a pump placed outside the housing in series with a duct for the injection of the fluid and a duct for the discharge of the fluid. In order to cool the fluid which is reinjected into the housing, a heat-exchange device is usually inserted in this circulation system which is located outside the housing.

The equipped housing is a moving element of an X-ray device, and the bulk of an external pump for the forced circulation of fluid constitutes a considerable hindrance. This bulk is increased even further by the cables for supplying current to the pump motor. Another drawback lies in the fact that these pumps require a specific electric supply. It should be added that this pump is liable to increase in bulk to an appreciable extent according to the nature of the fluid by reason of the degree of fluid-tightness to be provided for the cooling circuit. In this case the pumping section proper has to be driven by means of a magnetic coupling. Fluid-tightness as used in this context is understood to mean air-tightness, since the coolant fluid (oil) must be absolutely free from bubbles in order to prevent any breakdown at high voltage.

SUMMARY OF THE INVENTION

The present invention relates to an equipped forced-convection housing unit which is of considerably smaller overall size in comparison with the prior art and is much easier to employ in practice. This result is obtained by means of a novel arrangement of the housing and of the X-ray tube. In addition, the efficiency of cooling produced by the fluid is enhanced by means of this novel arrangement, since the action of the pumping device on the fluid is exerted in the present invention much nearer the location at which heat transfer is intended to take place.

In accordance with the invention, an equipped forced-convection housing unit comprising an X-ray tube having an anode which is mounted for rotation about a longitudinal axis of said X-ray tube, said anode being rotatably coupled to the rotor of a first motor in which the stator is placed outside an envelope of said X-ray tube and concentrically with said longitudinal axis, said X-ray tube being cooled by forced circulation of a fluid which is set in motion by a flow-initiating device, is distinguished by the fact that said flow-initiating device is placed within said housing unit and comprises a driving means placed concentrically with said longitudinal axis and in the line of extension of the first motor aforesaid.

BRIEF DESCRIPTION OF THE DRAWINGS

Other features of the invention will be more apparent upon consideration of the following description and accompanying drawings, wherein.

DETAILED DESCRIPTION OF THE INVENTION

Figure 1:
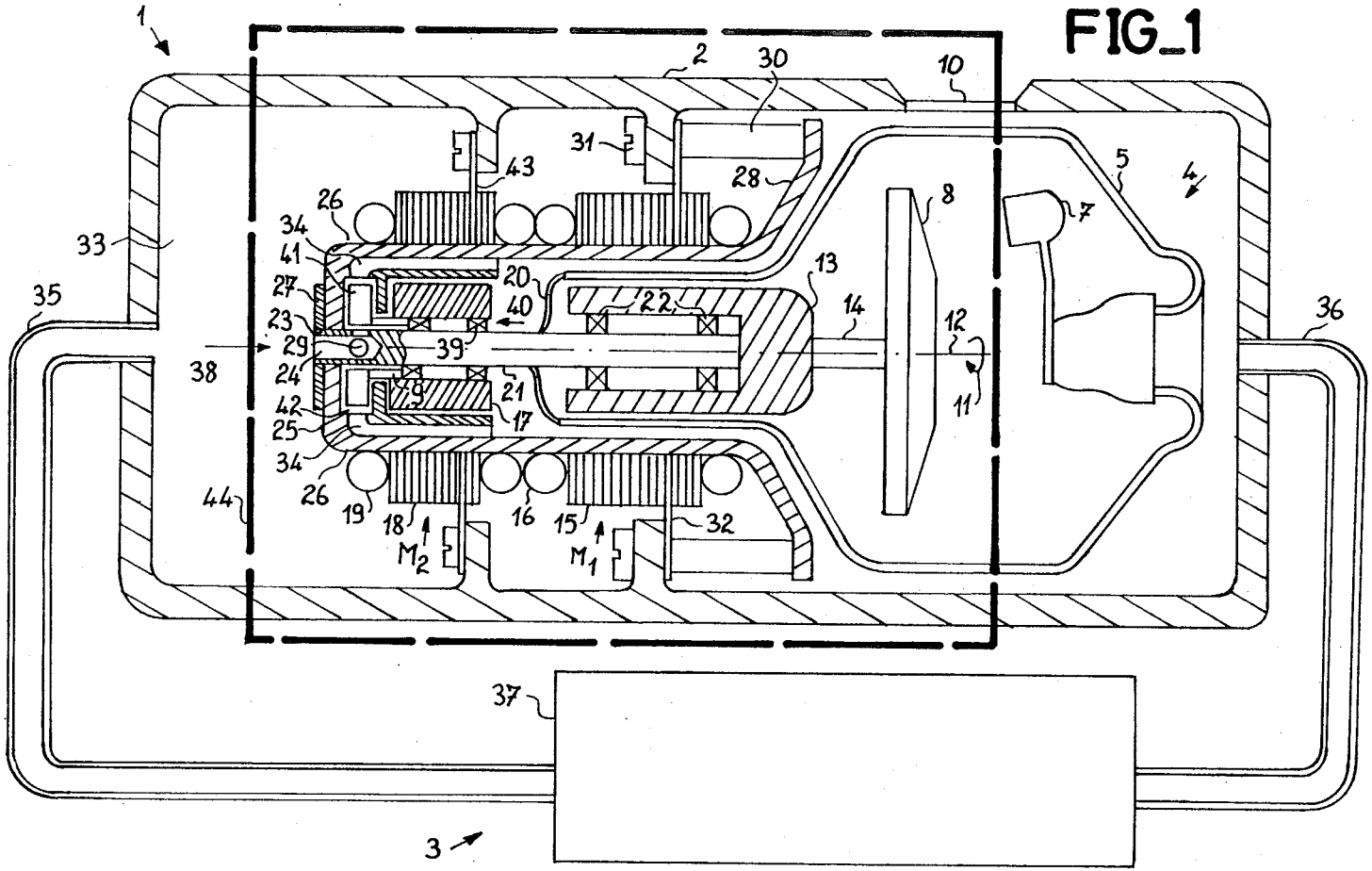
FIG. 1 illustrates a first embodiment of an equipped housing unit in accordance with the invention.

FIG. 1 shows diagrammatically an equipped forced-convection housing unit 1 in accordance with the invention, comprising a housing 2 and an external circulation system 3 for circulating a fluid (not shown) with which the housing 2 is filled. The housing 2 contains an X-ray tube 4, the envelope 5 of which is in contact with the fluid. In accordance with conventional practice, the X-ray tube 4 comprises a cathode 7 which is intended to deliver an electron beam (not shown in the drawings). During operation, the impact of the electron beam on a rotating anode 8 produces X-radiation (not shown) which emerges from the housing 2 through an exit window 10.

The anode 8 is caused to rotate in the direction indicated by a first arrow 11 about a longitudinal axis 12 of the X-ray tube 4. The rotating anode is driven by a first rotor 13 to which it is coupled by means of a supporting shaft 14. The first rotor 13 is placed along the longitudinal axis 12 and constitutes the moving portion of a first motor M1, the stator 15-16 of which is placed around the first rotor 13, concentrically with the longitudinal axis 12 and outside the envelope 5. The stator 15-16 shown in FIG. 1 is represented by a magnetic sheet circuit 15 and a winding 16.

In the non-limitative example herein described, the envelope 5 is closed at the end nearest the first rotor 13 by means of a metallic collar 20 which ensures air-tightness of the X-ray tube 4. The metallic collar 20 provides on the one hand a glass-metal seal with the envelope 5 and on the other hand a metal-metal seal with a stationary metallic shaft 21. The stationary shaft 21 supports the first rotor 13 through the intermediary of a first rolling-contact bearing means 22 and extends along the longitudinal axis 12 outside the X-ray tube 4 up to the end-wall 25 of a bell-shaped member 26. An end portion 23 of the stationary shaft 21 is secured to the end-wall 25 by conventional fastening means 27. The bell-shaped member 26 has a flared-out end portion 28 which is remote from the end-wall 25 and serves to secure the bell-shaped member 26 to the housing 2 by means of conventional fastening elements such as spacer members 30 and screws 31. The stator 15-16 is fixed separately to the housing 2 by means of a first main sheet 32 of the magnetic sheet circuit 15.

The external circulation system 3 comprises a first pipe 35 and a second pipe 36. The pipes 35 and 36 open into the housing 2 respectively at the end nearest the end-wall 25 and at the end nearest the cathode 7. These two pipes 35, 36 are connected to each other outside the housing 2 through a heat exchanger 37 of a conventional type such as a water-oil or air-oil heat exchanger. The fluid passes out of the housing 2 via the second pipe 36 and returns into the housing via the first pipe 35 after having been cooled by its passage through the heat exchanger 37.

In accordance with the invention, forced circulation of the fluid is produced by a flow-initiating device 40 mounted within the housing 2 itself in concentric relation with the longitudinal axis 12.

The flow-initiating device 40 comprises on the one hand a second motor M2 and on the other hand a fluid-actuating means constituted in the non-limitative example herein described by paddles 41, the paddles 41 are driven in rotation within a chamber 42 which is filled with the fluid.

The second motor M2 is mounted in the line of extension of the first motor M1 (which has the function of driving the anode 8 in rotation). In the non-limitative example herein described the second motor M2 comprises a second stator 18-19 placed outside and around the bell-shaped member 26 in the same manner as the first stator 15-16. The stator 18-19 shown in FIG. 1 is represented by a magnetic sheet circuit 18 and a winding 19. The second stator 18-19 produces rotational motion of a second rotor 17 which is placed within the bell-shaped member 26 and is rigidly fixed to the paddles 41 by means of a hollow rotating shaft 9. The second rotor 17 drives the paddles 41 in rotation about the longitudinal axis 12 in the direction of the first arrow 11. The second rotor 17 is supported by a second rolling-contact bearing means 39 on the stationary shaft 21 which already serves to support the first rotor 13.

The end portion 23 of the stationary shaft 21 is provided with a first bore 24 which extends along the longitudinal axis 12 and opens into second bores 29 which communicate with the chamber 42. This makes it possible to establish a communication between the chamber 42 and an admission space 33 into which the first pipe 35 discharges. The chamber 42 also communicates with fluid-flow ducts 34 formed within the thickness of the bell-shaped member 26 along the longitudinal axis 12.

In a manner which is known per se, the paddles 41 have a shape and an arrangement which are suited to the direction of rotation with a view to ensuring that the flow of fluid is oriented in the direction of a second arrow 38 in order to circulate from the admission space 33 to the chamber 42 via the first and second bores 24, 29. When it reaches the chamber 42, the fluid is displaced in rotational flow motion by the paddles 41 and tends to escape through the ducts 34 by centrifugation, then flows along the envelope 5 of the X-ray tube 4. The fluid passes out of the housing 2 via the second pipe 36 as explained earlier.

In a conventional manner (not shown in the drawings), the first stator 15-16 and the first rotor 13 can be at different potentials. By way of example, the first stator 15-16 can be at ground potential, and the first rotor 13 can be at a positive high-voltage potential. In the non-limitative example shown in FIG. 1, the stationary shaft 21 is metallic, with the result that the first and the second rotors 13, 17 are electrically connected together whilst the second stator 18-19 is attached to the housing 2 by means of a second main sheet 43 and is consequently at ground potential. In fact, only the magnetic sheet circuits 15 and 18 which form part respectively of the first stator 15-16 and the second stator 18-19 are connected to ground whilst their respective winding 16, 19 are at the line supply potential.

The electric power supply (not shown in the drawings) to the first and second stators 15-16, 18-19 can be effected either by supplying them simultaneously from a single supply source (which constitutes a simplification) or by supplying them separately. The advantage of the second solution lies in the facts that the movements of rotation are in that case totally independent and that the supply of current to the second stator 18-19 can therefore continue for the purpose of maintaining the forced circulation of fluid whilst rotation of the anode 8 and application of the load are interrupted.

The dashed outline 44 shown in FIG. 1 serves to delimit a portion of the housing 2 in order to represent this portion with greater clarity in the following figures.

Figure 2:
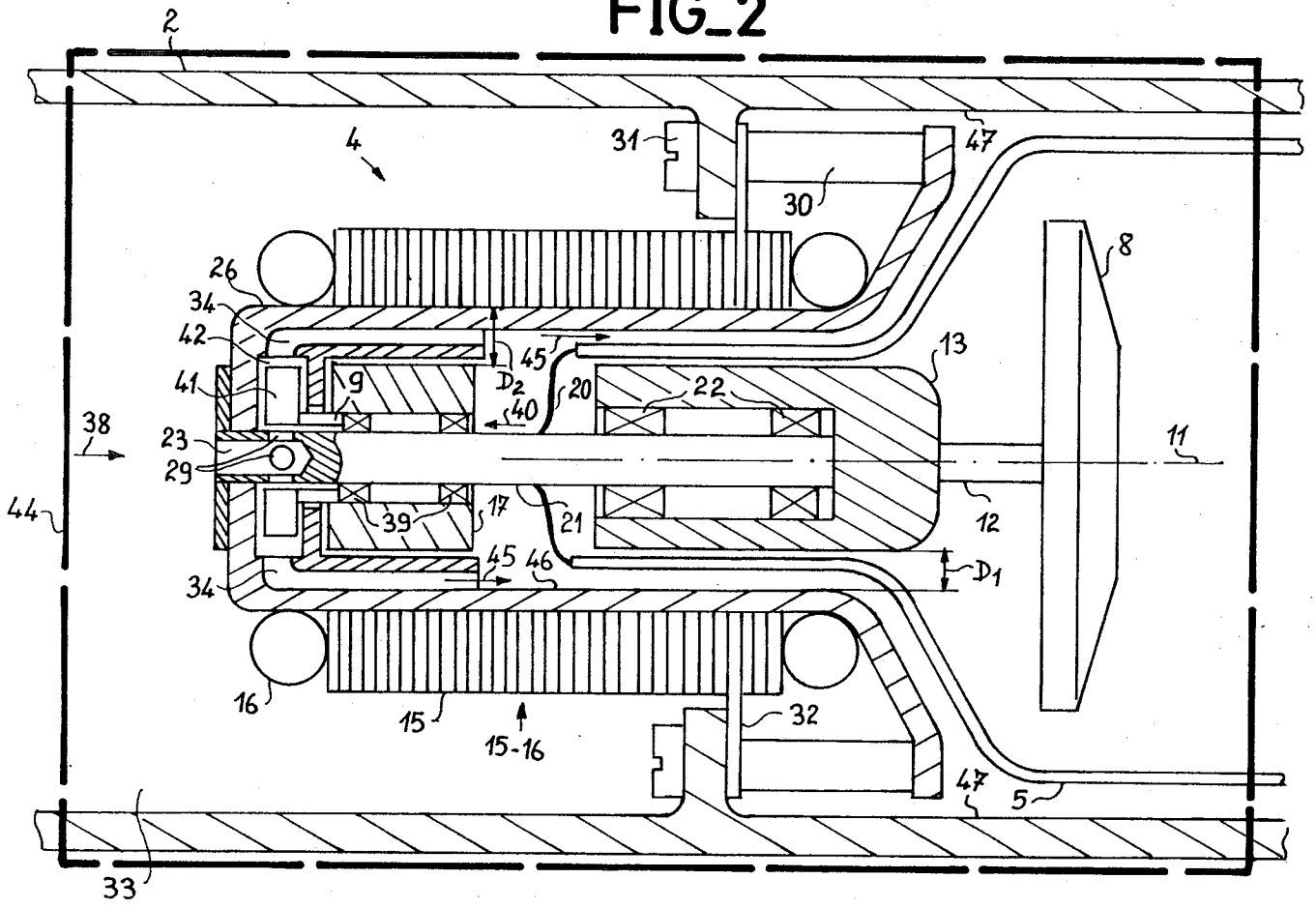
FIG. 2 illustrates a second embodiment of the invention.

FIG. 2 shows a second embodiment of the invention. One of the differences between this form of construction and the embodiment shown in FIG. 1 lies in the fact that the first stator 15-16 is common to the first rotor 13 and the second rotor 17.

In the example of this second embodiment, the magnetic sheet circuit 16 of the first stator 15-16 is extended in such a manner as to ensure that the length of the second rotor 17 is substantially inscribed within its internal volume. Application of voltage to the first stator 15-16 accordingly has the effect both of producing rotation of the first rotor 13 and consequently of the anode 8 and of producing rotation of the second rotor 17, thereby producing the forced circulation of the fluid. The speed of rotation of the second rotor 17 can be lower than that of the first rotor 13 by reason of the resisting torque produced by the fluid to be entrained.

As in the previous example, the first stator 15-16 is attached to the housing 2 by means of the first main sheet 32 which extends in a substantially radial direction between the bell-shaped member 26 and the housing 2. Apart from its attachment function, the first main sheet 32 constitutes a separation between the admission space 33 into which the first pipe 35 discharges and the remainder of the housing 2. This arrangement makes it possible to subject the fluid to a predetermined flow path such as the path already mentioned in the preceding example and hereinafter explained in detail. It should be observed that the above-mentioned separation function is also performed by the first main sheet 32 in the case of the preceding example, but that this function is not carried out by the second main sheet 43.

When the fluid has penetrated into the admission space 33, it circulates in the direction shown by the second arrow 38. Thus the fluid passes through the first and second bores 24, 29 and penetrates into the chamber 42, in which it is entrained by the rotation of the paddles 41 and escapes through the ducts 34. A point worthy of note is that the second rolling-contact bearings 39 alone provide a sufficient degree of fluid-tightness to prevent free flow of the fluid and to cause the fluid to escape through the ducts 34. If necessary, additional sealing means (not shown) can be employed—such as, for example, rotary seals placed at the level of the hollow rotating shaft 9. At the exit of the ducts 34, the fluid is first guided in the direction indicated by a third arrows 45 within the annular space located between the internal wall 46 of the bell-shaped member 26 and the envelope 5 of the X-ray tube 4, then guided into the annular space formed between the envelope 5 of the X-ray tube 4 and a wall 47 of the housing 2. The fluid thus transports the heat radiated by the rotating anode 8 and by the first rotor 13, then passes out of the housing 2 via the second pipe 36.

Since the first stator 15-16 alone is provided both for the first rotor 13 which serves to rotate the anode 8 and for the second rotor 17 which has the function of producing forced convection, it is only necessary to provide a single supply (not shown) for the purpose of driving the two rotors 13, 17 in rotation. Apart from the fact that this embodiment removes the inconvenience of pumping means placed outside the housing as in the prior art, it also simplifies power supply problems and dispenses with the need for one stator.

A further advantage which arises from this arrangement of a single stator 15-16 lies in the fact that the load on the anode 8 can be interrupted while maintaining the current supply to the stator 15-16 in order to maintain the forced convection when the rotating anode 8 is no longer subjected to the electron bombardment (not shown in the drawings).

In this second embodiment of the invention, the first rotor 13 and the second rotor 17 are electrically connected to each other by reason of the fact that they are supported by the same stationary metallic shaft 21 and can thus be brought to a positive high-voltage potential in the conventional manner. A first distance D1 and a second distance D2 between the first stator 15-16 and respectively the first rotor 13 and second rotor 17 represent a first and a second airgap which are substantially identical in the example described.

Figure 3:
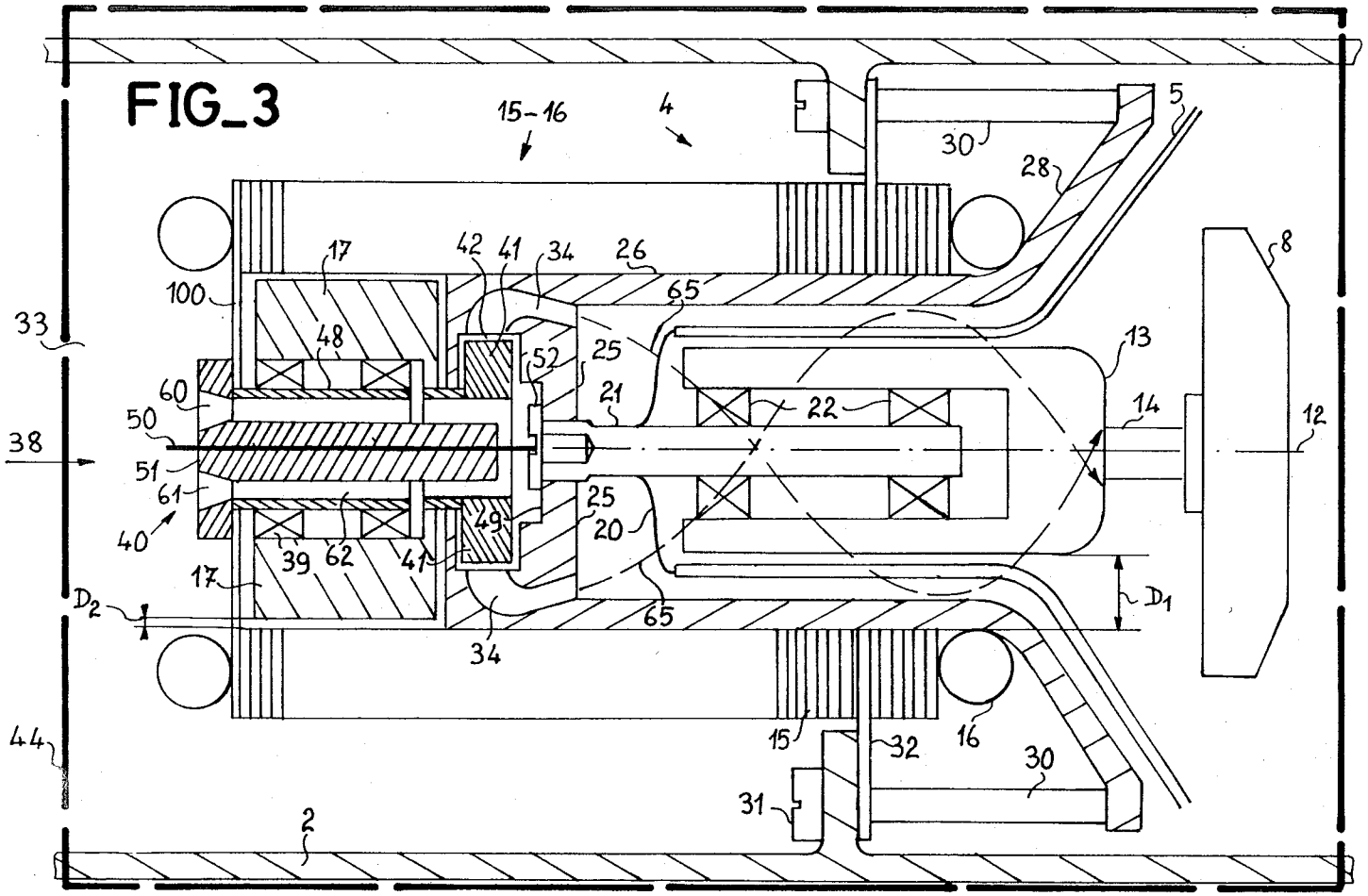
FIG. 3 illustrates a second form of construction of the embodiment shown in FIG. 2.

FIG. 3 shows a third embodiment of the invention in which the second rotor 17 constitutes the driving portion of the paddles 41 and is electrically isolated from the first rotor 13.

Under these conditions, the problems of electrical isolation between the first stator 15-16 and the second rotor 17 are removed, thus making it possible to reduce the second airgap D2 between the first stator 15-16 and the second rotor 17 and to dispense with the electrical isolator provided by the bell-shaped member 26 between the first stator 15-16 and the second rotor 17. This makes it possible, for example, to connect the second rotor 17 to ground, the first stator 15-16 being also connected to ground. This arrangement offers the advantage of achieving an appreciable reduction in the electric power which is applied to the first stator 15-16 and which is made necessary by the resisting torque of the fluid to be entrained.

Conversely, the first rotor 13 which induces rotational displacement of the anode 8 exerts a resisting torque of practically zero value once it has attained normal operating speed, thus calling for only a low sustaining power produced by the stator 15-16, and its airgap D1 can be larger than the second airgap D2. In consequence, the airgap D1 between the first rotor 13 and the first stator 15-16 can be maintained at a value which is compatible with the conditions of electrical isolation and the thickness of the envelope 5.

In this third embodiment of the invention as shown in FIG. 3, the second rotor 17 is carried by the second rolling-contact bearing means 39 on a stationary hollow shaft 48 placed along the longitudinal axis 12, the stationary hallow shaft 48 being metallic and independent of the stationary metallic shaft 21 which serves to support the first rotor 13. As in the previous examples, the stationary metallic shaft 21 is rigidly fixed to the end-wall 25 of the bell-shaped member 26. In this embodiment, however, the conventional fastening means 27 is replaced by a clamping screw 52.

In this embodiment of the invention, the bell-shaped member 26 is shorter and does not pass into the second airgap D2. The end-wall 25 of the bell-shaped member 26 is placed in proximity and in oppositely-facing relation to the metallic collar 20 which serves to close the X-ray tube 4. Attachment of the stationary metallic shaft 21 is effected within a wall 49 constituting the wall of the chamber 42 in which the paddles 41 are driven in rotation. Thus, in comparison with the previous examples, the relative arrangement of the paddles 41 and of the second rotor 17 is modified, since in this embodiment the paddles 41 are located between the first rotor 13 and the second rotor 17.

At the end nearest the admission space 33 into which it emerges, the stationary hollow shaft 48 is attached to the magnetic sheet circuit 15 by means of a metallic component 100.

Thus, since the second rotor 17 is in electrical contact with the magnetic sheets of the first stator 15-16, the second rotor 17 is brought to ground potential in the same manner as the stator.

The admission of the positive high-voltage potential within the housing 2 for the supply of the rotating anode 8 takes place in the conventional manner (not shown in the drawings). The application of the positive potential to the anode 8 is carried out by means of the first rotor 13. To this end, an electric lead 50 is connected to the means employed for attachment of the stationary metallic shaft 21, namely to the clamping screw 52, for example. In the non-limitative example herein described, the electric lead 50 is placed within an insulating sleeve 51 located between the admission space 33 and the stationary metallic shaft 21, along the longitudinal axis 12. The insulating sleeve 51 provides electrical insulation between the electric lead 50 (which is at a positive high voltage) and the metallic portions constituted by the second rotor 17 and the elements associated therewith, these latter being at ground potential.

The paddles 41 which serve to entrain the fluid and are rigidly fixed to the second rotor 17 are formed of insulating material with a view to providing a sufficient insulation distance between the second rotor 17 and the attachment of the stationary metallic shaft 21.

In this novel configuration, the fluid flows in the direction already shown by the second arrow 38 from the admission space 33 to the chamber 42 in which it is centrifugalized. The fluid passes into the chamber 42 via orifices 60, 61, which are not limited in number and which communicate with the admission space 33 as well as a new annular space 62 formed around the insulating sleeve 51. The new annular space 62 in turn communicates with the chamber 42 in which the rotation of the paddles 41 takes place. In the same manner as already explained earlier, the chamber 42 communicates with the fluid-flow ducts 34, which are also not limited in number and which may or may not be uniformly distributed around the longitudinal axis 12, depending on whether it is desired to produce either local or uniform heat removal. The fluid-flow ducts 34 preferably have rounded shapes in order to prevent turbulences and load losses. The orientation of the fluid-flow ducts 34 can be parallel to the longitudinal axis 12 or inclined with respect to this axis in order to subject the fluid circulation to helical movements (in which the fluid rotates about the envelope 5 of the X-ray tube 4) as represented by a fourth arrows 65 shown in dashed lines.

The foregoing description of an equipped forced-convection housing unit 1 shows that it is possible to reduce the overall size of an equipped housing unit of this type by integrating within the housing 2 the flow-initiating device 40 for producing forced circulation of the fluid which fills the housing and also permits the achievement of significant savings both in labor and equipment, since the invention does not require any specific power supply for a pump and is limited in particular to a single stator 15-16 which is common to the rotating anode 8 and to the forced convection.

What is claimed is:

1. An X-ray assembly comprising:

(a) a housing having an inlet and an outlet;

(b) an external circulation system coupled to said inlet and to said outlet for circulating a cooling fluid through said housing during use of the assembly;

(c) an envelope disposed in said housing;

(d) a first motor comprising a first stator disposed in said housing outside said envelope and a first rotor electrically coupled to said first stator, said first rotor being disposed in said envelope and being concentric to a longitudinal axis;

(e) an anode disposed in said envelope and mechanically coupled to said first rotor for rotation about said longitudinal axis; and (f) a flow-initiating device disposed in said housing outside said envelope, said flow-initiating device comprising:

(i) a second motor comprising a second stator disposed in said housing outside said envelope and a second rotor electrically coupled to said second stator, said second rotor being disposed in said housing outside said envelope and being concentric to said longitudinal axis, and (ii) a fluid driving means mechanically coupled to said second rotor for rotation about said longitudinal axis.

2. An X-ray assembly as recited in claim 1 wherein:

(a) said flow-initiating device further comprises a chamber for centrifugation of the cooling fluid;

(b) said fluid driving means comprises at least one paddle; and (c) said at least one paddle is disposed in said chamber.

3. An X-ray assembly as recited in claim 2 wherein said chamber communicates with discharge ducts through which the cooling fluid is directed toward said envelope.

4. An X-ray assembly as recited in claim 3 wherein said discharge ducts are oriented in parallel to said longitudinal axis.

5. An X-ray assembly as recited in claim 3 wherein said discharge ducts are inclined with respect to said longitudinal axis so as to cause helical movement of the cooling fluid about said longitudinal axis.

6. An X-ray assembly as recited in claim 2 wherein said chamber is placed between said first rotor and said second rotor.

7. An X-ray assembly as recited in claim 6 wherein said at least one paddle is formed of electrically insulating material.

8. An X-ray assembly as recited in claim 7 wherein said second rotor is electrically connected to said first stator and electrically isolated from said first rotor.

9. An X-ray assembly as recited in claim 1 wherein said first rotor and said second rotor are electrically connected to each other.

10. An X-ray assembly as recited in claim 1 wherein said first rotor and said second rotor are mounted on the same supporting shaft.

11. An X-ray assembly as recited in claim 10 wherein said supporting shaft is a metallic shaft.

12. An X-ray assembly as recited in claim 1 wherein:

(a) said first rotor is supported by a first stationary shaft;

(b) said second rotor is supported by a second stationary shaft;

(c) said second stationary shaft is hollow; and (d) said second stationary shaft is independent of said first stationary shaft.

13. An X-ray assembly comprising:

(a) a housing having an inlet and an outlet;

(b) an external circulation system coupled to said inlet and to said outlet for circulating a cooling fluid through said housing during use of the assembly;

(c) an envelope disposed in said housing;

(d) a stator disposed in said housing outside said envelope, said stator being concentric to a longitudinal axis;

(e) a first rotor electrically coupled to said stator, said first rotor being disposed in said envelope and being concentric to said longitudinal axis;

(f) an anode disposed in said envelope and mechanically coupled to said first rotor for rotation about said longitudinal axis; and (g) a flow-initiating device disposed in said housing outside said envelope, said flow-initiating device comprising:

(i) a second rotor electrically coupled to said stator, said second rotor being disposed in said housing outside said envelope and being concentric to said longitudinal axis, and (ii) a fluid driving means mechanically coupled to said second rotor for rotation about said longitudinal axis.

14. An X-ray assembly as recited in claim 13 wherein:

(a) said flow-initiating device further comprises a chamber for centrifugation of the cooling fluid;

(b) said fluid driving means comprises at least one paddle; and (c) said at least one paddle is disposed in said chamber.

15. An X-ray assembly as recited in claim 14 wherein said chamber communicates with discharge ducts through which the cooling fluid is directed toward said envelope.

16. An X-ray assembly as recited in claim 14 wherein said discharge ducts are oriented in parallel to said longitudinal axis.

17. An X-ray assembly as recited in claim 15 wherein said discharge ducts are inclined with respect to said longitudinal axis so as to cause helical movement of the cooling fluid about said longitudinal axis.

18. An X-ray assembly as recited in claim 14 wherein said chamber is placed between said first rotor and said second rotor.

19. An X-ray assembly as recited in claim 18 wherein said at least one paddle is formed of electrically insulating material.

20. An X-ray assembly as recited in claim 19 wherein said second rotor is electrically connected to said stator and electrically isolated from said first rotor.

21. An X-ray assembly as recited in claim 13 wherein said first rotor and said second rotor are electrically connected to each other.

22. An X-ray assembly as recited in claim 13 wherein said first rotor and said second rotor are mounted on the same suporting shaft.

23. An X-ray assembly as recited in claim 22 wherein said supporting shaft is a metallic shaft.

24. An X-ray assembly as recited in claim 13 wherein:

(a) said first rotor is supported by a first stationary shaft;

(b) said second rotor is supported by a second stationary shaft;

(c) said second stationary shaft is hollow; and (d) said second stationary shaft is independent of said first stationary shaft.

* * * * *